United States Patent [19]

Smith

[11] 4,084,281

[45] Apr. 18, 1978

[54] FLUID-POWERED ROTARY BRUSH

[76] Inventor: Eugene David Smith, 3100 Hollins, Bakersfield, Calif. 93305

[21] Appl. No.: 705,950

[22] Filed: Jul. 16, 1976

[51] Int. Cl.[2] ..... A46B 13/06

[52] U.S. Cl. ..... 15/29; 15/50 R

[58] Field of Search ..... 15/29, 24, 50 R, 51, 15/98, 320; 51/134.5 F, 170 T

[56] References Cited

U.S. PATENT DOCUMENTS

| | | | |
|---|---|---|---|
| 846,636 | 3/1907 | Wensinger | 15/29 |
| 1,673,094 | 6/1928 | Stack | 15/29 |
| 2,101,216 | 12/1937 | Grueschow | 15/29 X |
| 2,678,457 | 5/1954 | Demo et al. | 15/29 |
| 3,114,164 | 12/1963 | Riordan | 15/29 |

FOREIGN PATENT DOCUMENTS

| | | | |
|---|---|---|---|
| 1,253,079 | 12/1960 | France | 15/29 |
| 618,563 | 3/1961 | Italy | 15/29 |
| 284,765 | 12/1952 | Switzerland | 15/29 |

*Primary Examiner*—Edward L. Roberts

*Attorney, Agent, or Firm*—D. Gordon Angus; Donald D. Mon

[57] ABSTRACT

A turbine wheel in the cavity of a turbine housing is driven by liquid, ordinarily water, introduced into the housing through a conduit which can draw the liquid from a reservoir. The turbine wheel is rotatable on a shaft which is attached to the housing and extends downward through the housing to a position below the housing where a brush is rotatable on the shaft. The brush is driven by the turbine through an arrangement of gears. Openings through the turbine housing are positioned to permit the water passing through the housing to flow downward in a 360° circle around the exterior of the brush. The turbine functions as an air pump drawing air into the housing which aids in forcing the water out the exit openings so that less water volume and pressure is required to force the water out in the 360° circle than would otherwise be necessary. The water with the air falls upon the surface which is to be brushed, so that when the brush device is moved along the surface, the brush rotates on the wet layer on the surface to produce the cleaning action.

3 Claims, 6 Drawing Figures

TANK
56
57
58
P
V
9
10
11
54
60
61
62
23

47a
47
20
47b
50
51
52
48
13
49a
49
46
60
14
45

30
33
39
29
32
34
31

23
26

FLUID-POWERED ROTARY BRUSH

This invention relates to power-driven rotary brushes, and more particularly to such brushes which are fluid powered.

Power-driven rotary brushes are well know, for example in street-cleaning operations. Such brushes are ordinarily attached to relatively heavy structures such as motor vehicles and the like. There are situations where a relatively small lightweight fluid power-driven rotary brush would be desirable, for example, where it is desirable to hand-carry the brush and handhold it in use, as a portable unit. There are also instances where it is desirable to use a fluid such as water for cleaning or washing during operation of the brush.

An object of this invention is to provide such a small lightweight, fluid-powered rotary brush unit.

A related object is to provide such a unit which is portable.

A further related object is to provide for using fluid which powers the brush for the purpose of washing or cleaning during the brushing operation.

The invention is carried out by the provision of a turbine wheel in a turbine housing and means for injecting pressurized liquid such as water or other suitable liquid to the turbine. A rotary brush driven by the turbine is positioned below the housing. Exit opening means through the housing permits fluid from the housing to fall around the perimeter of the brush to supply cleaning or washing fluid on the surface to be brushed during the brushing operation.

According to a preferred feature the turbine wheel is rotatable on a shaft attached to the housing and extending downward to a position below the housing where the rotary brush is rotatable on the shaft. Means is provided for driving the brush in rotation from the power-driven turbine wheel.

According to another feature provision is made for admitting air into the housing so that the turbine acts as an air-pump drawing the air into the housing, which thereby aids in forcing the liquid out the exit opening means at the circle of the perimeter. Because of this air less liquid flow rate and pressure are required to eject the liquid out around the perimeter than would be required if the air were not being pumped.

Additional features reside in the provision of air flow channels at the turbine wheel, cooperating with the liquid flow.

The foregoing and other features of the invention will be better understood from the following detailed description and the accompanying drawing of which:

Figure 1:
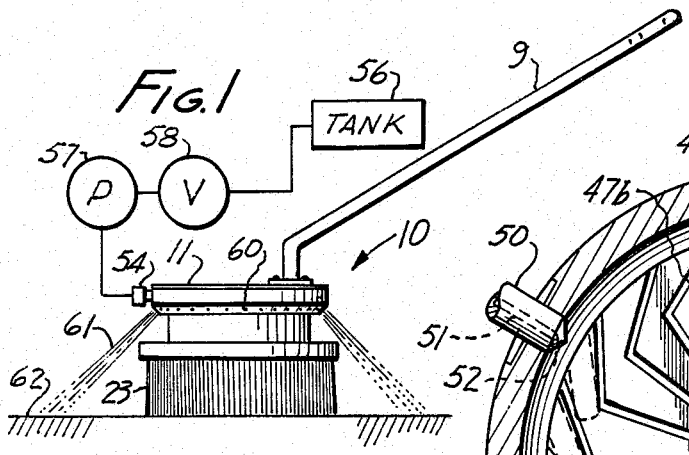
FIG. 1 is an elevation view of a rotary brush unit according to this invention.

Referring to the drawings, the brush device comprises a housing 10 having a generally flat horizontal circular top 11, a generally flat horizontal circular bottom 12 and a cylindrical side 13 with a cavity 14 formed by the space defined by the top, bottom and side. At the center of the top 11 there is provided a hole 15 into which there is fitted the upper end of a shaft 16 on a vertical axis provided with a flange 17 fastened to the top member 11 by bolts 18. The portion **16*a*** of the shaft extending below the flange for a substantial distance is of somewhat lesser diameter than the portion above the flange.

A turbine wheel 20 is mounted for rotation relative to the shaft on a step bearing 21, within the housing 14, the hub portion 22 of the turbine wheel serving as a bottom closure for the housing in cooperation with member 12.

A brush 23, preferably of circular or annular cross-section, is attached at its upper end to the bottom side of a circular horizontal member 24 so that the bristles of the brush extend downward from member 24. Member 24 is fastened to a support 25 by suitable means such as bolts 26. Support 25 has a flat circular section **25*a* against the lower side of which the upper side of member 24 is in contact, and also has a depending collar portion 27 at its hub attached to a step bearing 28 at the lower end of shaft portion 16*a*. Thus, the turbine wheel 20 and the brush are each rotatable on shaft portion 16*a***.

Figure 2:
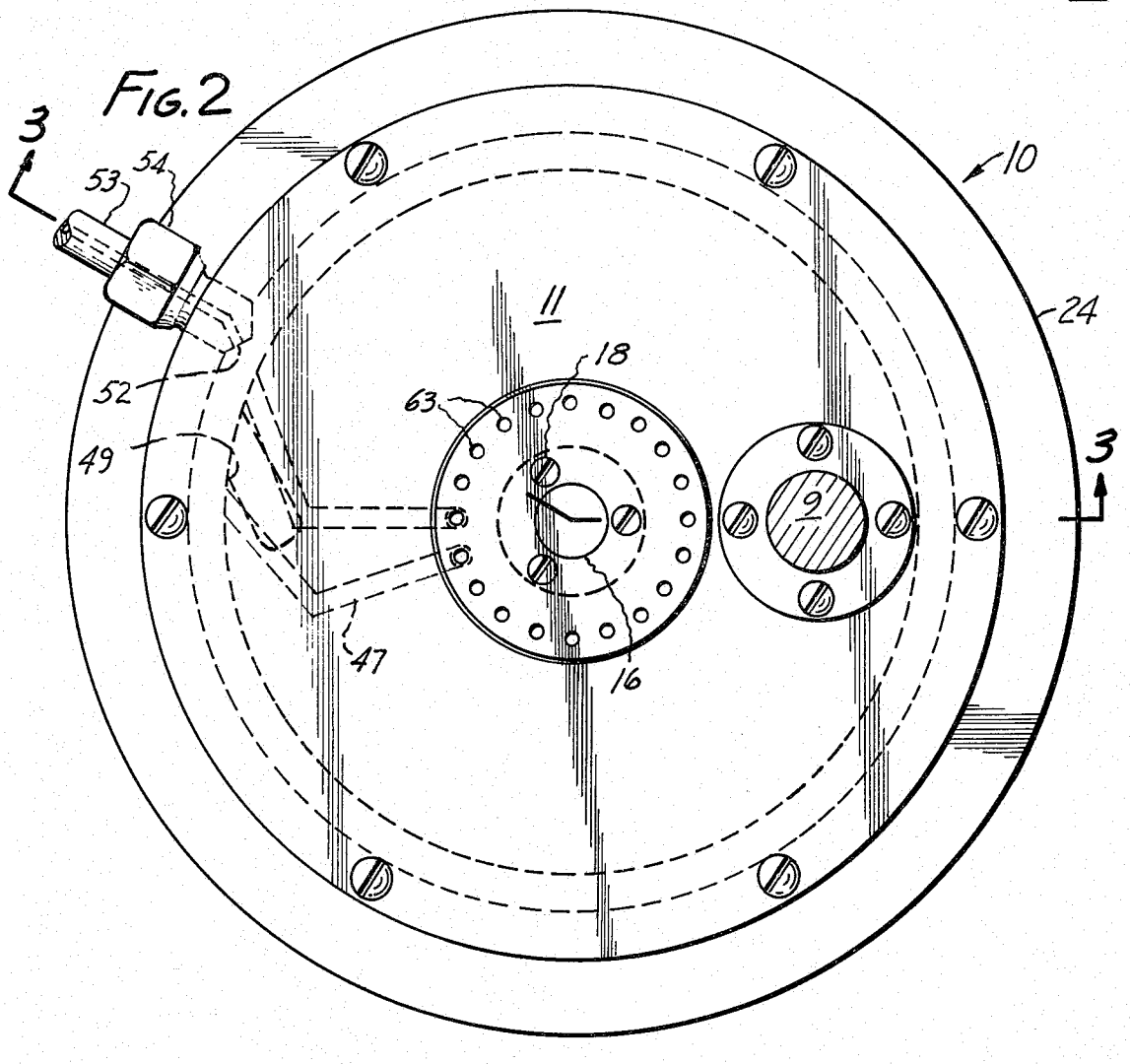
FIG. 2 is a top view of the turbine housing and brush shown in FIG. 1.

The turbine wheel and the brush are mechanically geared to each other by a gear system comprising gear wheels 29, 30 and 31, rotatable on respective pins 23, 33 and 34 fastened to, and depending from, the bottom member 12 of the turbine wheel housing. This is done by means of a flange 35 attached to each pin and set into a recess 36 of member 12. A washer-bearing 37 supported by a head 38 fastened near the bottom end of each pin supports the respective gear wheel. The lower end **22*a* of turbine hub 22 is provided with peripheral gear teeth 39 which engage the teeth of the gear wheels 29, 30 and 31. The periphery of support member 25 is provided with an upstanding peripheral rim 40 within which there is fixed a ring 41 provided with inwardly extending teeth 42 which mesh with the teeth of gear wheels 29, 30 and 31. It is seen that when the turbine wheel 20 is caused to rotate on shaft member 16*a* in one direction, for example counter-clockwise with reference to FIG. 2, the gear wheels 29, 30 and 31 are all caused to rotate on their pins, which causes the brush member 24** to rotate in the direction opposite that of the turbine wheel, that is, clockwise when the turbine wheel rotates counter-clockwise.

Figure 4:
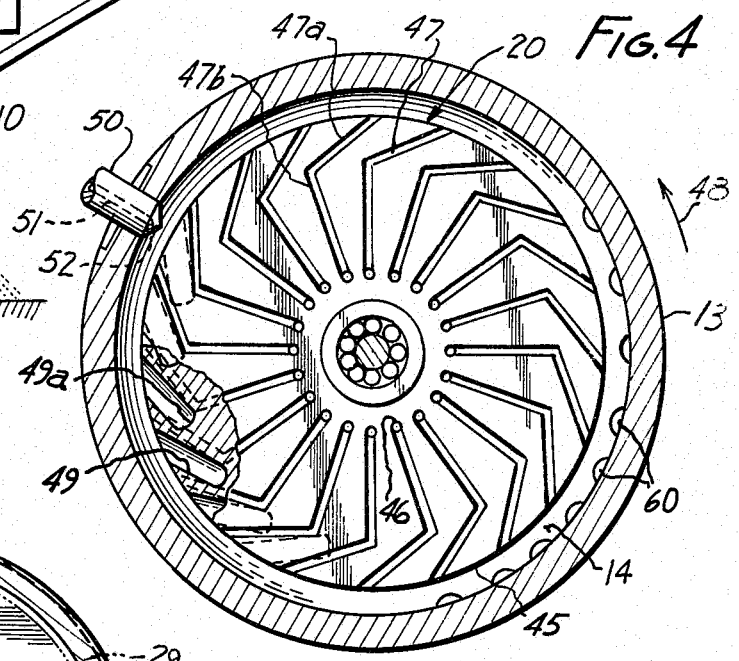
FIG. 4 is a cross-section view taken at line 4—4 of FIG. 3.
Figure 5:
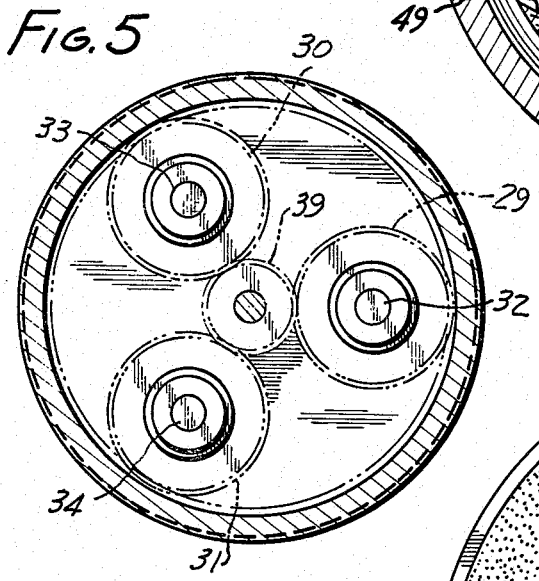
FIG. 5 is a cross-section view taken at line 5—5 of FIG. 3.
Figure 6:
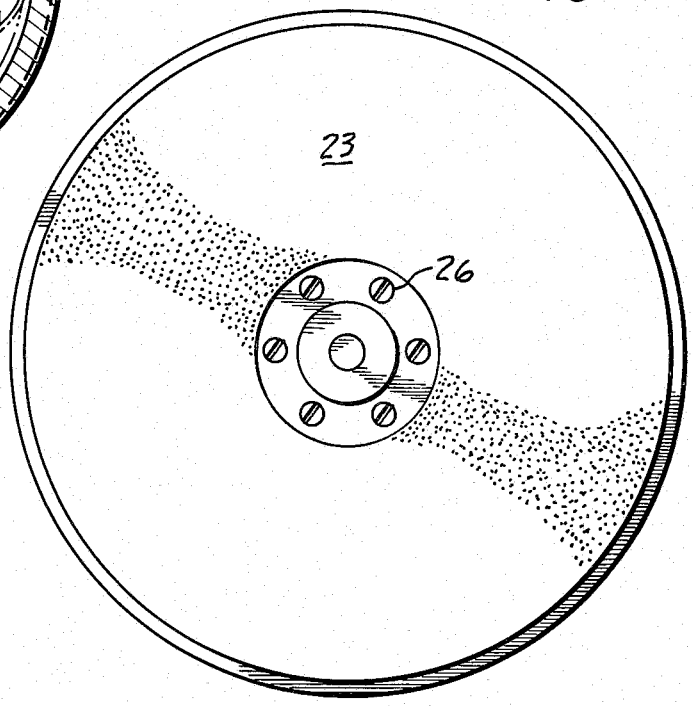
FIG. 6 is a bottom view showing the brush, taken from line 6—6 of FIG. 3.

The turbine wheel comprises a plate 45 in the shape of a generally flat circular disc having through it a number of regularly spaced holes 46 arranged in a circle near the hub, as best seen in FIG. 4. The top and bottom surfaces of the disc 45 are each provided with indented grooves 47 equal in number to the number of holes 46. The outer end of each groove is at the periphery of the disc and the inner end of each groove is at an individual one of holes 46. Each groove 47 at the underside of the disc is exactly beneath and underlying a corresponding groove 47 at the upper side of the disc, and each groove is formed as two straight lengths **47*a* and 47*b* at an angle to each other as seen in FIG. 4. The lengths 47*b* of all the grooves extend radially with reference to the axis of rotation of the turbine wheel, but the lengths 47*a* all have a component in the direction of rotation of the turbine wheel which is counter-clockwise as indicated by arrow 48 in FIG. 4**, as will appear presently.

Between the upper and lower surfaces of the turbine wheel discs 45 there are formed a number of bores 49 each commencing at the periphery and extending inwardly but slanted in the direction of rotation. All the bores are of the same length and each terminates at a position 49a within the disc. The number of bores is equal to the number of grooves 47 at each side of the disc and the bores are angularly positioned so that they lie generally angularly between adjacent grooves 47.

A liquid inlet nozzle 50 passes through the side wall 13 of the turbine wheel housing with its axis in alignment with the central plane of disc 45. The nozzle 50 is provided with a fluid passageway 51 which is bent at its exit end 52 so that this end is directed in substantial alignment with the axis of each bore 49 as it comes into registration with the nozzle, as best seen in FIG. 4. A fluid conduit 53 is attached outside the housing to the nozzle 50 by suitable means such as a coupling member 54.

Liquid can be forced through nozzle 50 in the direction of arrow 55 from a suitable reservoir or tank 56 as indicated diagrammatically in FIG. 1 and pressurized by a pump 57 (which may be electrically operated by a battery or otherwise) after opening a valve 58 at the outlet from the tank. The pump, valve and tank may be arranged to be carried by the brush device unit itself, so that the unit is completely portable and not required to be in proximity to a source of liquid such as water.

Figure 3:
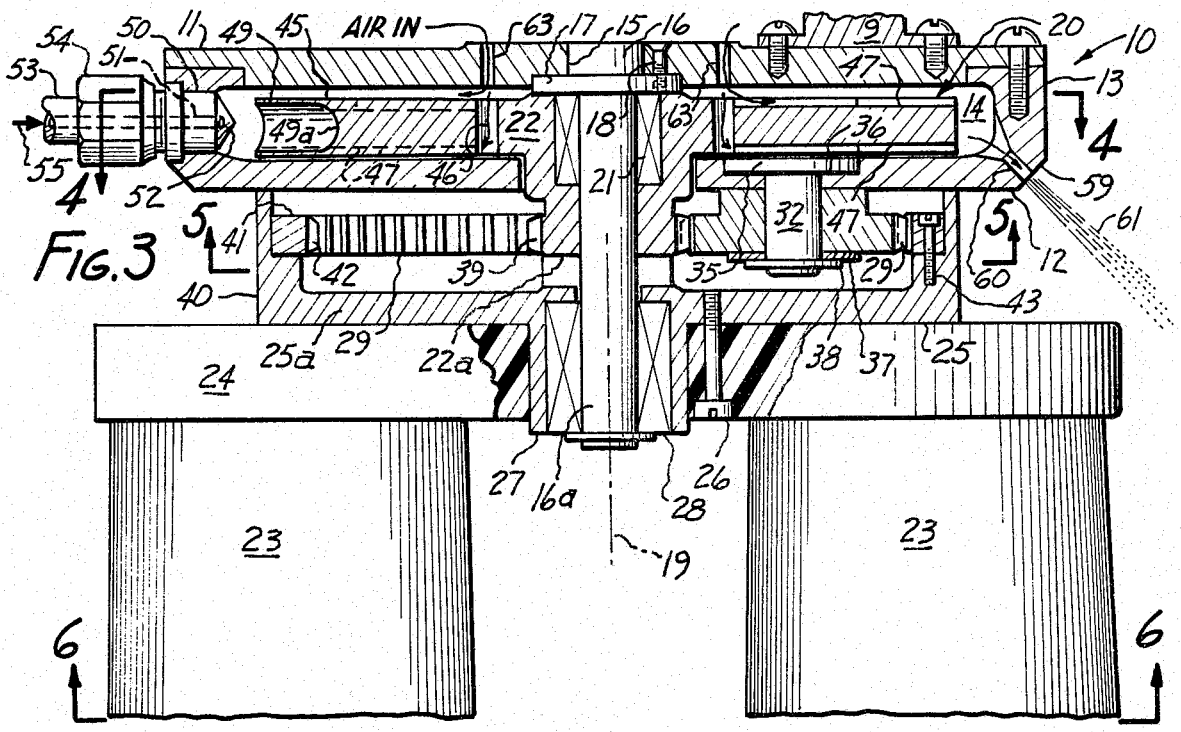
FIG. 3 is a cross-section view taken at line 3—3 of FIG. 2.

At the junction of the bottom 12 and side 13 of the turbine wheel housing the housing is beveled to a frusto-conical shape 59, and through this frusto-conical portion there are formed a number of spaced holes 60 providing communication between the turbine wheel cavity 14 and the exterior of the housing. These holes extend diagonally, that is, downward and outward relative to the turbine housing, and their axes are preferably directed so that they clear the periphery of the brush as indicated in FIGS. 1 and 3.

The cover plate 11 of the turbine housing has formed through it a number of holes 63 arranged equidistant in a circular pattern. The holes 63 are positioned relative to the holes 46 of the turbine wheel, so that while the wheel is rotating successive holes 46 will come into alignment with successive holes 63. Preferably the number and spacing of holes 63 is the same as those of holes 46.

To operate the rotary fluid-operated brush, pressurized fluid such as water or other suitable liquid is caused to flow through the nozzle 50 in the direction of arrow 55 which may be done by the operator opening the valve 58 and turning on the pump 57. The liquid emerging from the nozzle within the turbine cavity 14 impinges as a jet into successive bores 49 of the turbine wheel causing the turbine wheel to rotate in a well-known manner which will be in the counter-clockwise direction in the present case, in view of the angularity of the nozzle outlet and the bores 49. This will cause clockwise rotation of the brush. The liquid thus entering cavity 14 occupies space within the cavity and exits from the peripherally arranged exit openings 60 to spray what might be referred to as a conical spray 61 enveloping the brush and depositing the fluid on the surface 62 being brushed.

As the liquid moves into and through and out of the turbine wheel cavity 14 air will be pumped by aspiration into the turbine cavity through holes 61. Some of the air will pass radially outward to the periphery of the turbine wheel through grooves 47 both at the upper side and lower side of the turbine wheel disc. The holes 47 periodically registering with the holes 63 will permit some of the air intermittently to move into and through the lower grooves. The air mixed with the liquid will give the liquid a bubbly quality so that the conical envelope of liquid 61 will be bubbly, which will enhance the cleaning action of the brush. While the liquid and air are being thus pumped through the turbine cavity the operator will move the brush along the surface 62 by pushing or pulling on handle 9 attached to the top of the turbine cavity.

By reason of pumping the air by the turbine, the pumping of the liquid through the turbine and its distribution around the 360° periphery of the housing are facillated with the result that a lesser flow rate of the liquid, normally water, and a lesser pumping pressure at pump 57 are required than would be the case if there were no provision for pumping the air.

The invention is not to be limited to the embodiment shown in the drawing and described in the specification, which is given by way of example and not of limitation, but only in accordance with the scope of the appended claims.

I claim:

1. A fluid-powered rotary brush comprising:

a housing having a cavity;

a shaft positioned on a normally vertical axis within the cavity and extending below the cavity;

a turbine wheel within the cavity and rotatable on said axis;

brush support means rotatable on said axis at a position below, and spaced from the turbine wheel housing;

a circular brush attached to and depending from the brush support means;

means for injecting pressurized fluid into the cavity to rotate the turbine wheel;

means interconnecting the turbine wheel and the brush support means to produce rotation of the brush support means when the turbine wheel rotates; and fluid outlet means through the housing positioned with axes of fluid flow directed downwardly and outwardly relative to the housing and clearing the periphery of the brush so as to spray fluid from the cavity over and beyond, and not contacting, the periphery of the brush; said turbine wheel having a plurality of peripheral bores spaced from each other, each bore being slanted with a component of direction radially inward and another component of direction tangential in the direction which the wheel will turn, and said fluid injecting means being directed to inject fluid into each bore successively as the wheel turns, thereby torquing the wheel, a wall surface of the turbine wheel being provided with a plurality of spaced grooves extending in a generally radial direction from the periphery of the wheel toward the axis of the wheel, and a plurality of holes through the housing wall adjacent the grooves, through which atmospheric air is aspirated into the cavity while fluid is flowing through the cavity from the fluid injecting means to the fluid outlet means;

whereby the sending of pressurized fluid through the fluid injection means into the cavity produces rotation of the turbine wheel and of the brush and causes fluid to spray from the cavity through the opening means onto a surface being brushed beyond the periphery of the rotating brush.

2. A rotary brush according to claim 1 in which each groove comprises two lengths which make an angle to each other, the outermost length having a component which is tangential in the direction of rotation of the wheel, and the innermost length being more radial than the outermost length.

3. A rotary brush according to claim 1 in which the radial grooves are located on both the upper and the lower surfaces of the turbine wheel and holes through the turbine wheel provide communication between the grooves on the upper surface and respective grooves on the lower surface.

* * * * *